United States Patent [19]

Trostle et al.

[11] Patent Number: 4,643,080

[45] Date of Patent: Feb. 17, 1987

[54] ROOF RIDGE VENTILATOR SYSTEM

[75] Inventors: John W. Trostle, 1880 Concord Dr., Allison Park, Pa. 15101; James D. Klingensmith, Apollo, Pa.

[73] Assignees: Aluminum Company of America; John W. Trostle, both of Pittsburgh, Pa.

[21] Appl. No.: 748,021

[22] Filed: Jun. 24, 1985

[51] Int. Cl.[4] ..... F24F 7/02

[52] U.S. Cl. ..... 98/42.21; 52/199; 52/726

[58] Field of Search ..... 52/199, 726; 98/42.2, 98/42.21; 403/305, 313, 314, 309

[56] References Cited

U.S. PATENT DOCUMENTS

| | | | |
|---|---|---|---|
| 333,603 | 1/1886 | Cortright | 52/726 X |
| 3,054,482 | 9/1962 | Lassen | 52/726 X |
| 3,188,772 | 6/1965 | Tennison, Jr. | 52/726 X |
| 3,508,368 | 4/1970 | Tischuk et al. | 52/726 X |
| 3,862,529 | 1/1975 | Markos | 98/42.21 X |
| 4,257,206 | 3/1981 | Mieyal | 52/726 X |

*Primary Examiner*—Harold Joyce

*Attorney, Agent, or Firm*—Andrew Alexander; John P. Taylor

[57] ABSTRACT

A roof ridge ventilator system of the type adapted to be installed on the open ridge of a building's roof. The ventilator system is provided in at least two elongated sections having ends with top parts which are joinable together endwise. The top part of one end is fabricated to enable overlapping by the top part of an unfabricated end of another section of roof ridge ventilator. The overlapping inhibits migration of water between the overlapped ends. The fabricated top part is further provided with a capillary groove in its outer surface which also is to be overlapped by the unfabricated end of the other ventilator section when the ends are joined. The groove is located, sized and configured to (1) collect water attempting to enter the ridge vent opening by migrating between the overlapping ends, and (2) dispose of said water collecting in said groove to minimize the possibility of said water entering the ridge vent opening.

9 Claims, 5 Drawing Figures

ROOF RIDGE VENTILATOR SYSTEM

BACKGROUND OF THE INVENTION

This invention relates to ventilators for space below the roof of a building and, in particular, to roof ridge ventilators for exhausting air from the attic of a house.

Roof ridge ventilators are installed on the open ridge of a building's roof for exhausting heated air from the space below the roof. They are often installed in cooperation with ventilators at the soffits of the building's roof so as to provide a ventilation system in which outside air is drawn in from the soffit ventilators, passed through the space below the roof and then exhausted through the roof ridge ventilator. An example of such a ventilator system is disclosed in U.S. Pat. No. 3,036,508.

While roof ridge ventilators could be fabricated to extend the entire length of a building's roof ridge, it is generally desirable, both from an economic and a practical standpoint, to fabricate ventilators in sections which typically have a length of about 10 feet. Abutting sections of such ridge ventilators are sometimes joined by supports, such as the T-shaped support pieces 23 disclosed in U.S. Pat. No. 3,326,113 to Smith et al. The joint areas in such systems are usually weatherproofed by affixing a cover piece over the ends of the adjoining ventilator sections such as outer cap 28 illustrated in Smith. It is also known that ventilator sections may be jointed by molded polyvinyl chloride plugs. The plugs generally have a shape conforming to the inside profile of the ridge ventilator and are approximately 1½ inches wide. The respective ventilator ends are typically joined by inserting the plug halfway (i.e. ¾ inch) into the open end of a first ventilator section which is already installed (i.e., nailed) on the roof's ridge. The end of a second uninstalled section is then slid onto the exposed half of the plug having been inserted into the first section. The second section is then nailed to the roof over the ridge vent, and the process is repeated with another section.

While the aforementioned means for joining ventilator sections provide relatively weatherproof connections, they are somewhat expensive since they use parts such as the previously mentioned supports, cover pieces and/or plugs. Accordingly, to reduce costs, it would be desirable if a weather-resistant means for connecting the adjoining ventilator sections could be designed that would not require the use of such parts.

SUMMARY OF THE INVENTION

The present invention provides a weather-resistant roof ridge ventilator. The ventilator is provided in at least two elongated sections which are joined together endwise in a weather-resistant manner. Each ventilator section has a top part, a pair of outer sides depending from the top part, a pair of ventilating louvered panels spaced below the top part and extending from the sides inwardly towards each other to form a throat in ventilating flow communication with the open ridge of the building's roof, and a pair of flashing panels spaced below the louvered panels and extending downwardly and outwardly from the throat formed by the louvered panels.

The weather-resistant means for joining the ventilator sections endwise includes a first end of one ridge ventilator section having a top part and a second end of another ridge ventilator section having a top part. The second end's top part is adapted to be overlapped by at least a portion of the inner surface of the first end's top part. Such overlapping of the respective ends serves to inhibit the migration of water and moisture between the joined ends. In a preferred embodiment, the second end further defines at least one capillary groove in the outer surface of the second end's top part. The groove is located, sized and configured to (1) collect water attempting to migrate to the ridge vent opening through areas between the joined overlapping ends, and (2) dispose of such collected water in a manner preventing it from entering the ridge vent opening.

DETAILED DESCRIPTION OF THE PREFERRED EMBODIMENTS

Figure 1:
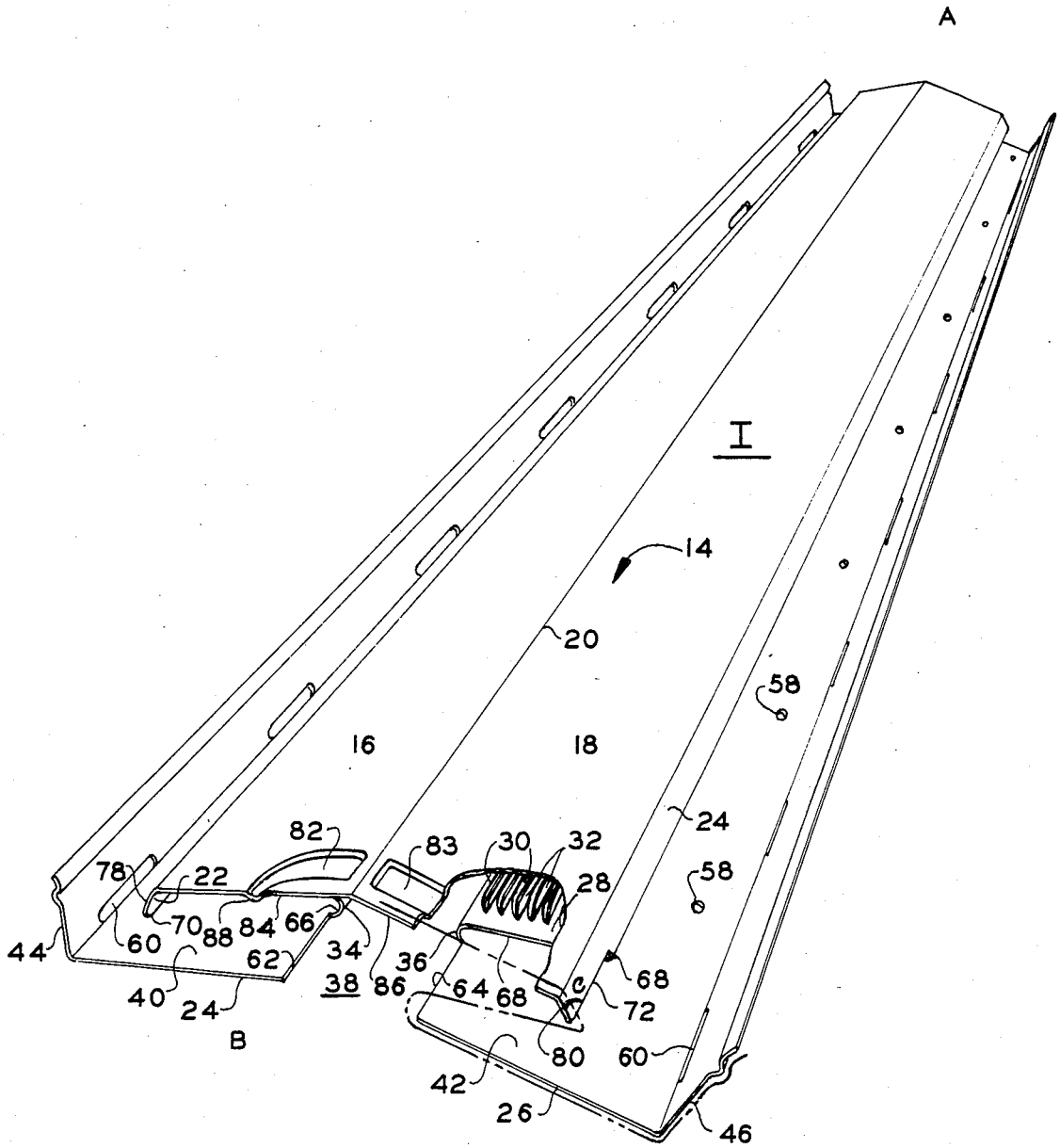
FIG. 1 provides a perspective view of a section of ridge ventilator of the present invention.
Figure 2:
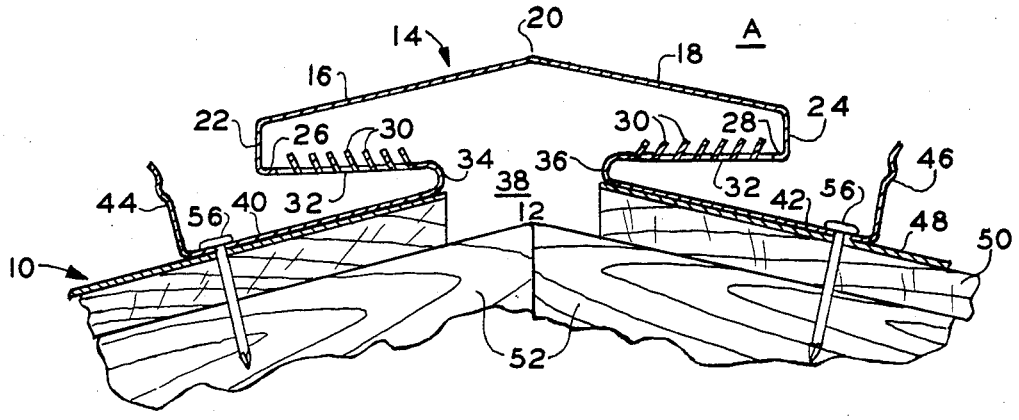
FIG. 2 provides an end view of end A of the ventilator section illustrated in FIG. 1.

FIG. 1 illustrates a perspective view of a section of roof ridge ventilator of the present invention which is referred to herein as ridge vent section I. As can be seen therein, section I is provided with a straight unfabricated end referred to herein as end A and a fabricated end referred to herein as end B. FIG. 2 provides a cross-sectional elevational view of end A mounted on a roof 10 of a building having a roof ridge vent opening 12. From FIGS. 1 and 2, those skilled in the relevant art will be able to see that ridge vent section I is provided with a conventional top part 14 having both a left top part 16 and a right top part 18 depending from a central apex 20. Also provided is a pair of outer sides 22 and 24 which integrally depend from the edges of left and right top parts 16 and 18, respectively. In addition, a pair of louvered panels 26 and 28 extend from said sides 22 and 24, respectively, inwardly toward one another and are spaced below the top part 14. Panels 26 and 28 are provided with louvers 30 which are integrally formed within panels 26 and 28. Louvers 30 are formed upwardly into the roof ridge ventilator to provide openings 32 for exhausting heat from the attic.

Inner sidewalls 34 and 36 depend respectively from the inner edges of panels 26 and 28 to form a throat 38 which, as illustrated in FIG. 2, is generally in alignment with ridge vent opening 12 when mounted on a building's roof. Flashing panels 40 and 42 are generally spaced below louvered panels 26 and 28 and, respectively, extend outwardly from the inner sidewalls 34 and 36 to protrude beyond the outer sides 22 and 24. Baffles 44 and 46 upstand from ends of the flashing parts 40 and 42, respectively, and are selectively spaced from the outer sidewalls 22 and 24 to prevent blowing snow and rain water from entering the louvered openings 32.

The components of roof 10, as illustrated in FIG. 2, which are typical of conventional residential buildings include roofing material 48, such as shingles, overlying sheathing 50 which is supported by rafters 52. The ventilator is secured to roof 10 by fasteners such as nails 56 extending through nail holes 58 in flashing parts 40 and 42 and passing into roofing material 48, sheathing 50 and rafters 52. Apertures 60, which are commonly known as weep holes, are provided in baffles 44 and 46 at spaced distances from one another along the length of the ventilator section to provide means for drainage of moisture from the ventilator section.

Figure 3:
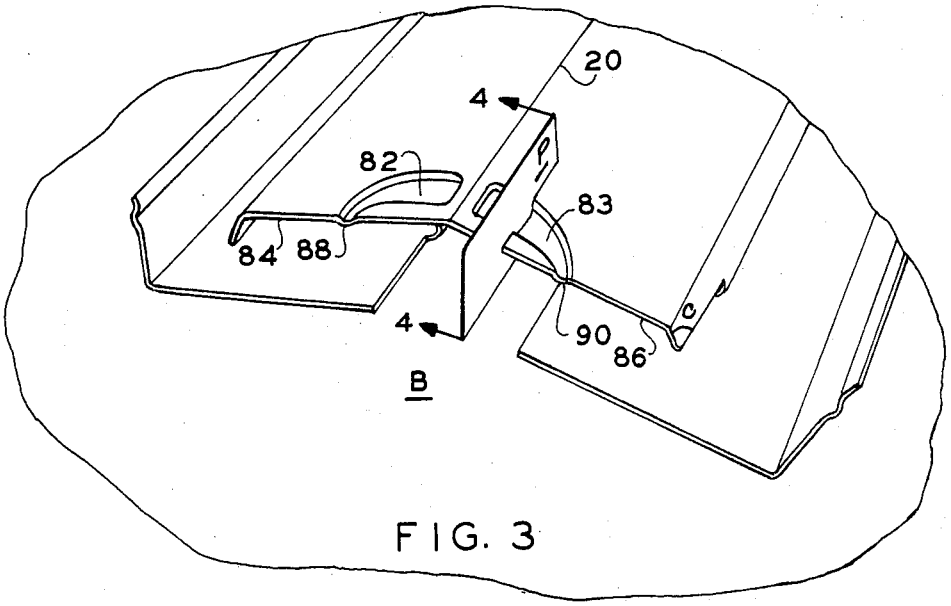
FIG. 3 provides a perspective end view of end B of the ventilator section illustrated in FIG. 1 and, in addition, illustrates a phantom plane P which runs parallel to apex 20 and transversely passes through groove 83.

FIGS. 1 and 3 provide perspective views of a preferred embodiment of end B of the present invention. Those skilled in the relevant art will appreciate that end B is integral with ridge vent section I but, for illustrative purposes, will be described herein as a partial extension of section I. The extension is partial in the sense that while top parts 16 and 18, outer sides 22 and 24, flashing panels 40 and 42 and baffles 44 and 46 form parts of end B, louvered panels 26 and 28 do not. In fabricating end B, louvered panels 26 and 28 are preferably removed by a cutting or stamping. After their removal, it can be seen from the drawings that end B defines throat edges 62 and 64, inner louvered panel end edges 66 and 68 and tapered side edges 70 and 72. Throat edges 62 and 64 extend, respectively, from flashing edges 74 and 76 to inner end edges 66 and 68 along a line which, prior to the louvered panels' removal, defined the integral interfaces between the inner sidewalls 34 and 36 and their respective flashing panels 40 and 42. In the embodiment illustrated, the throat edges have a length of about $1\frac{1}{4}$ inches. Tapered side edges 70 and 72 also preferably are provided with a length of about $1\frac{1}{4}$ inches. They extend, respectively, from outer side end edges 78 and 80 to inner end edges 66 and 68 along a line which, prior to removal of the louvered panels, generally defined the integral interface between the respective outer sides and louvered panels. In contrast to the throat edges, however, side edges 70 and 72 are preferably tapered such that the included angle identified as angle C between the respective side end edges and the tapered side edges is slightly obtuse; i.e., greater than 90°. Such tapering, as will be explained in more detail infra, facilitates joining of one ridge vent section to another. Inner louvered panel end edges 66 and 68 extend, as can be seen in the cutaway view of FIG. 1, from the respective throat edge to the respective tapered side edge.

Figure 4:
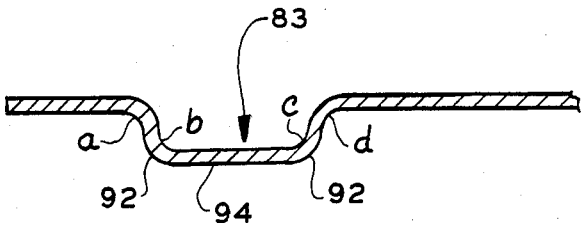
FIG. 4 is a view taken along lines 4—4 of FIG. 3 which illustrates the cross-sectional shape of groove 83 at the point where phantom plane P of FIG. 3 passes through groove 83.

In addition to cutting out the louvered panel portions as described above, it can be seen in FIGS. 1 and 3 that fabricated end B is provided with a pair of capillary, water collecting grooves 82 and 83 which are formed in end B's top part 14. Each groove extends from an area near the top part's central apex 20, across its respective top part half 16 or 18 and then through or over its respective top part half end edge 84 or 86. The ends of grooves 82 and 83, which extend over end edges 84 and 86, are referred to herein, respectively, as water discharge ends 88 and 90. It can also be seen that each groove narrows as it travels towards its discharge end. FIG. 3 is provided with a vertically oriented phantom plane P which passes through groove 83 near apex 20. The depiction of plane P serves to highlight groove 83's rounded cross-sectional shape. A better view of such is provided in FIG. 4 which illustrates the cross-sectional shape of the groove as viewed in the direction of lines 4 of FIG. 3 which extend from plane P in a normal direction. As can be seen therefrom, groove 83 has sides 92, a bottom 94 and rounded corners a, b, c and d, all of which can be easily formed with conventional tooling. In the embodiment illustrated, the bottom has a width of approximately $\frac{1}{4}$ inch and a depth of approximately 0.08 inch. Corners a, b, c and d have radii of curvature of approximately 1/16 inch and the sheet material from which the ridge vent was formed is 0.19 gauge AA Series 3003 aluminum alloy. AA 3005 aluminum alloy can also be used. The width and depth of each groove at its discharge end are $\frac{1}{8}$ inch and 1/32 inch, respectively.

Figure 5:
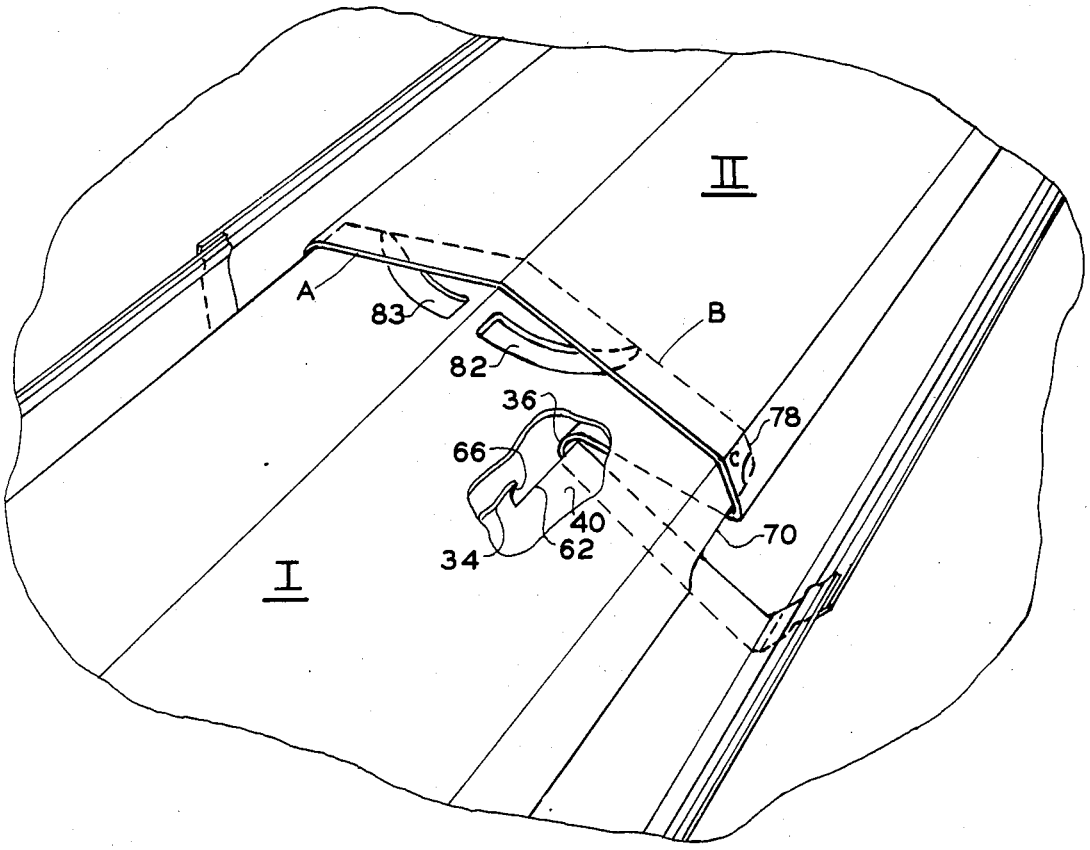
FIG. 5 provides a perspective view which illustrates the partial joining of an end A of one ventilator section to an end B of another ventilator section.

FIG. 5 illustrates the partial joining of section I's end B to an end A of another section of ridge vent which, for illustrative purposes, will be referred to herein as ridge vent section II. The ends are shown partially joined because it is easier to visualize the respective parts of the ventilator in this state as opposed to showing the ends fully joined.

In this partially joined state, end B, as illustrated, is partially inserted into the open end of section II's unfabricated end A. Those skilled in the relevant art will appreciate that the tapering of side edges 70 and 72 facilitates the installation process of inserting end B into end A. It can also be visualized from FIG. 5 that when the ends are fully joined, the edge of end A's inner sidewall 36 will be in contact with end B's inner louvered panel end edge 66. It can also be visualized that end B's top part 14 and outer sides 22 and 24 will be completely overlapped by end A's corresponding parts. End B's grooves 82 and 83 will also be completely covered by the respective top part halves of end A.

With respect to the flashing panels and baffles, it can be seen that in contrast to end A's overlapping end B's top part, end A's flashing panels and baffles are overlapped by those of end B. End A's flashing and baffle sections could overlap those of end B but the illustrated configuration is preferred because it is easier to install.

The cutaway portion of FIG. 5 also illustrates a perspective view of throat edge 62 which is formed by cutting out the louvered panels during the fabrication of end B. As can be seen in the drawing, throat edge 62 is provided by cutting into the end precisely at the integral interface between the flashing panel 40 and inner sidewall 34 which, as can be seen, is directly at the point where the inner sidewall begins curving up away from the planar surface of flashing panel 40. Locating throat edge 62 along this line serves to minimize the possibility of water leakage through this area when the ends are fully joined.

When the ridge ventilator sections I and II are fully joined and installed over the open ridge of a building's roof, migration of rain water and other precipitation through the joint area will be minimized. Water attempting to migrate between the overlapped ends will collect in the capillary grooves and then be discharged through the groove's discharge ends. The discharged water will fall onto upwardly directed louvers 30 and pass through louver openings 32. From there, the water will fall onto the flashing panels and exit the ventilator through weep holes 60. Those skilled in the relevant art will appreciate that the present invention not only provides a highly weather-resistant and effective roof ridge ventilator system, but also a less expensive system requiring fewer parts than previously known systems.

While the invention has been described in terms of preferred embodiments, the claims appended hereto are intended to encompass all embodiments which fall within the spirit of the invention.

What is claimed is:

1. In a roof ridge ventilator system of the type adapted to be installed on the open ridge of a building's roof, wherein said ventilator system comprises. at least two elongated sections having ends, said sections being joinable together endwise, each of said sections having a top part, a pair of outer sides depending from the top part, a pair of ventilating louvered panels spaced below the top part and extending from the sides inwardly towards each other so to form a throat in ventilating flow communication with the open ridge, a pair of flashing panels spaced below the louvered panels and extending downwardly and outwardly from the throat formed by said louvered panels, and a pair of baffles upstanding from the outer edge of each flashing panel, said baffles having openings in the lower part thereof; the improvement comprising means for reducing the likelihood of water entering the roof ridge opening due to water migration between joined ventilator section ends, said means including a first end of one ridge ventilator section having a top part and a second end of another ridge ventilator section having a top part, said second end's top part being adapted to be overlapped by at least a portion of the first end's top part, said overlapping inhibiting the migration of water between the overlapped top parts, said second end's top part further defining at least one capillary groove in its outer surface, said groove comprising means to (1) collect water attempting to enter the ridge vent opening by migrating between the overlapped parts, and (2) dispose of said water collecting in said groove by permitting said water to flow over the end edge of said second end at a point where it will fall onto said flashing panels of said one ridge ventilator section and out said opening in said baffles of said one ridge ventilator section so that the possibility of said water entering the ridge vent opening is minimized.

2. A roof ridge ventilator as recited in claim 1 wherein said first end has a pair of outer sides and said second end has a pair of outer sides, said second end's outer sides being adapted to be overlapped by at least a portion of the first end's outer sides.

3. A roof ridge ventilator as recited in claim 2 wherein each of the second end's outer sides terminates at an end edge and additionally defines a tapered side edge which adjoins the end edge, said adjoining edges defining an included angle greater than 90°.

4. A roof ridge ventilator as recited in claim 1 wherein said first end has a pair of flashing panels and said second end has a pair of flashing panels.

5. A roof ridge ventilator as recited in claim 1 wherein said first and second ends are integral with their respective ventilator sections.

6. A roof ridge ventilator as recited in claim 1 wherein the second end's top part terminates at an end edge and the capillary groove disposes of said collected water by permitting it to flow over said end edge at a point wherein the water will intersect a portion of the underlying end of the adjoining roof ridge ventilator section, said water disposal area of the groove being referred to as a water discharge end.

7. A roof ridge ventilator as recited in claim 6 wherein the second end's top part includes a right and left half separated by an apex, said right and left half each being provided with a capillary groove which extends across the respective half from an area near the top part's apex to the respective water discharge end of the capillary groove of the respective right or left half of the second end's top part.

8. A roof ridge ventilator as recited in claim 1 wherein said flashing panels protrude beyond the outer sides to form upstanding baffle means which inhibit blowing snow and rain from entering the ridge vent opening through the openings in the louvered panels.

9. An improved roof ridge ventilator system suitable for installation on the open ridge of a building's roof comprising at least two elongated ventilator sections each having first and second ends, said sections being joinable together endwise, each of said sections comprising:

(a) a top part;

(b) a pair of outer sides depending from the top part;

(c) a pair of ventilating louvered panels spaced below the top part and extending from the sides inwardly towards each other so as to form a throat in ventilating flow communication with the open ridge;

(d) a pair of flashing panels spaced below the the louvered panels and extending downwardly and outwardly from the throat formed by said louvered panels;

(e) a pair of baffles upstanding from the outer edge of each flashing panel, said baffles having opening in the lower part thereof;

(f) means for reducing the possibility of water leakage into the underlying roof ridge due to water leakage between adjoining ventilator sections comprising:

(1) a first end on each of said ventilator sections;

(2) a second end on each of said ventilator sections having a top part adapted to be overlapped by at least a portion of said top part of a first end of an adjoining section to inhibit the passage of water between adjoining ventilator sections;

(3) means on said top part of said second end for inhibiting the migration of water between said overlapped top parts comprising at least one capillary groove in the outer surface of said second end of said ventilator section to collect water attempting to enter the ridge vent opening by migrating between the overlapped parts, and to dispose of said water collecting in said groove, said means to dispose of said water collecting in said groove comprises means to permit said water to flow over the end edge of said second end of said ridge ventilator section onto said flashing panels of said adjoining ridge ventilator section out said opening in said baffles of said ridge ventilator section;

whereby the likelihood of water entering the roof ridge vent opening due to water migration between joined ventilator section ends is minimized.

* * * * *